US005596337A

United States Patent [19]

Merenda

[11] Patent Number: 5,596,337

[45] Date of Patent: Jan. 21, 1997

[54] SLOT ARRAY ANTENNAS

[75] Inventor: Joseph T. Merenda, Northport, N.Y.

[73] Assignee: Hazeltine Corporation, Greenlawn, N.Y.

[21] Appl. No.: 515,796

[22] Filed: Aug. 16, 1995

Related U.S. Application Data

[63] Continuation of Ser. No. 203,186, Feb. 28, 1994, abandoned.

[51] Int. Cl.[6] ..... H01Q 13/10

[52] U.S. Cl. ..... 343/770; 343/906

[58] Field of Search ..... 343/768, 770, 343/771, 789, 906, 767, 872, 890; H01Q 13/10

[56] References Cited

U.S. PATENT DOCUMENTS

| | | | |
|---|---|---|---|
| 3,015,822 | 1/1962 | Brown et al. | 343/771 |
| 3,056,130 | 9/1962 | Charman | 343/767 |
| 3,218,644 | 11/1965 | Berry | 343/770 |
| 3,518,688 | 6/1970 | Stayboldt et al. | 343/789 |
| 3,633,207 | 1/1972 | Ingerson et al. | 343/770 |
| 3,696,433 | 10/1972 | Killion et al. | 343/770 |
| 3,795,915 | 3/1974 | Yoshida | 343/771 |
| 4,054,874 | 10/1977 | Oltman, Jr. | 343/700 MS |
| 4,196,436 | 4/1980 | Westerman | 343/770 |
| 4,409,595 | 10/1983 | Park . | |
| 4,710,775 | 12/1987 | Coe | 343/727 |
| 4,775,866 | 10/1988 | Shibata et al. | 343/700 MS |
| 4,845,506 | 7/1989 | Shibata et al. | 343/713 |
| 4,907,008 | 3/1990 | Dienes | 343/890 |
| 4,958,165 | 9/1990 | Axford et al. | 343/770 |
| 4,985,708 | 1/1991 | Kelly | 343/771 |
| 5,158,820 | 10/1992 | Scammell | 343/700 MS |
| 5,189,433 | 2/1993 | Stern et al. | 343/770 |
| 5,289,200 | 2/1994 | Kelly | 343/771 |
| 5,337,065 | 8/1994 | Bonnet et al. | 343/767 |

*Primary Examiner*—Michael C. Wimer
*Attorney, Agent, or Firm*—E. A. Onders; K. P. Robinson

[57] ABSTRACT

Simplified, high reliability slot array antennas are usable in cellular communication systems. In a flat panel form, an antenna includes a slot array with simplified feed enclosed within a back panel and a front radome structure. Use of a simplified feed, consisting of a vertical aluminum rod dielectrically spaced from an aluminum sheet including a vertical array of horizontally aligned slot openings, is made possible by horizontal slot offsets. With a linear feed rod, signal coupling to each slot in series is determined by the horizontal location of each slot relative to the feed rod. With a capacitive input coupling, there are no electrical contacts or connections in the internal feed path which may cause intermodulation effects. With a grounded aluminum array sheet and case construction, and capacitively-coupled feed, the antenna is resistant to lightning strikes. Antenna models with different beam tilts merely require substitution of an aluminum array sheet with different slot configurations punched therein. Narrower azimuth beamwidths are provided by use of multiple slot arrays and multiple beam antennas are adaptable to use of beam forming networks and active antenna beam steering and nulling techniques.

6 Claims, 4 Drawing Sheets

SLOT ARRAY ANTENNAS

This application is a continuation of application Ser. No. 08/203,186 filed on Feb. 28, 1994 now abandoned.

This invention relates to slot array antennas and, more particularly, to high reliability, cost effective slot array antennas providing broad band performance while having a reduced number of components and physical contacts in the signal path.

BACKGROUND OF THE INVENTION

With the expansion of cellular and other wireless communication services, there is a growing requirement for antennas suitable for communications with cellular telephones and other mobile user equipment. These antennas are typically provided in fixed installations on buildings or other structures in urban and other areas. The characteristic of the use of a large number of contiguous cell coverage areas of relatively small size, particularly in urban installations, results in the need for installation of large numbers of antennas. Relatively low power operation is generally involved, however, the need to provide reliable communications service to a population of users moving through coverage areas with varying transmission characteristics places special requirements on the antennas.

While many types of antennas are available for these applications, prior antennas typically have one or more of the following undesirable characteristics: limited performance, high cost, high component count and assembly labor, signal path connections subject to generating spurious intermodulation effects, limited reliability, high susceptibility to lightning damage, bandwidth or beamwidth limitations, high design and fabrication costs for reconfiguration for different applications, limited flexibility for beamwidth or beam tilt variations, unattractive visual characteristics, large front to back dimensions and special tower or other mounting requirements.

Some antenna characteristics are particularly significant in cellular and similar applications. Contacts or physical connections in the signal path can, over time, degrade and result in spurious intermodulation effects which are unacceptable in cellular applications. Achieving high performance and reliability with low cost places emphasis on a low component count and ease of production and assembly. Adaptability to a variety of installations and operating requirements is enhanced by a construction with flexible design aspects. Adaptability to beam forming and active antenna beam steering and null control techniques is facilitated by antennas providing multiple beam capabilities. Particularly in urban locations, antenna esthetics and the capability of enabling unobtrusive antenna placement on the sides of buildings are significant objectives. Susceptibility to lightning damage can place systems out of service and result in high costs of antenna replacement.

Objects of this invention are, therefore, to provide new and improved types of slot array antennas, and antennas having qualities which favorably address one or more of the previously identified characteristics.

SUMMARY OF THE INVENTION

In accordance with the invention, a slot array antenna operable over a frequency band includes a first conductive sheet section having horizontal, vertical and thickness dimensions, and a first array of slots comprising a plurality of radiating elements in the form of vertically arrayed elongated openings in the first conductive sheet section. At least one of the slots is offset horizontally relative to one other of the slots. Excitation means consisting of a single linear conductive member is positioned in spaced relation to a back side of the first conductive sheet section and extends across each of the slots for coupling slot excitation signals. The positioning of the linear conductive member relative to the slots causes the offset to affect the level of coupling of excitation signals with respect to each offset slot. Dielectric means, positioned between the first conductive sheet section and excitation means, is included for supporting the linear conductive member in spaced relation to the first conductive sheet section. A second conductive sheet section extends at least partially coextensively with the back side of the first conductive sheet section and in spaced relation to the linear conductive member. Coupling means, which may utilize capacitive signal coupling, is provided for enabling signals to be coupled to and from the linear conductive member. The slot array antenna additionally includes a radiation transmissive radome structure, a portion of which is positioned in front of the first array of slots.

Other slot array antennas in accordance with the invention may include a second similar, horizontally-separated array of slots utilized in parallel to provide a narrower horizontal beamwidth, or second, third and fourth similar arrays to provide separate beams or beam forming capabilities. Arrays of diagonal slots may be utilized to provide diagonal linear polarization and crossed diagonal slots may be included in antennas using the invention to provide beams with circular or other polarization.

For a better understanding of the invention, together with other and further objects, reference is made to the accompanying drawings and the scope of the invention will be pointed out in the accompanying claims.

DESCRIPTION OF THE INVENTION

Figure 1:
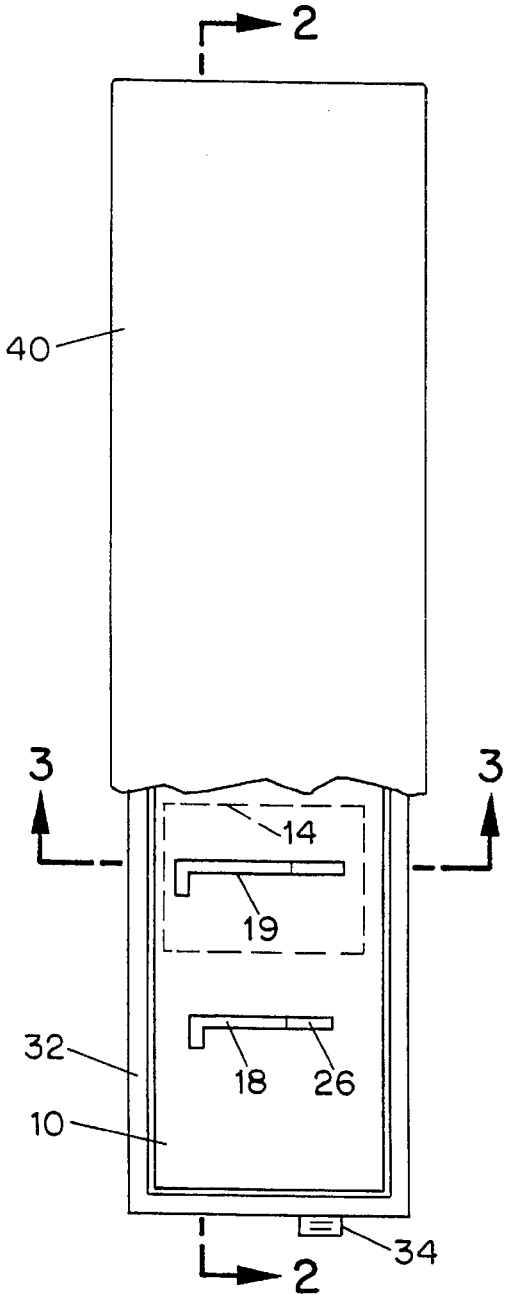
FIG. 1 is a front view of a slot array antenna in accordance with the invention, with a lower section of the radome removed.
Figure 2:
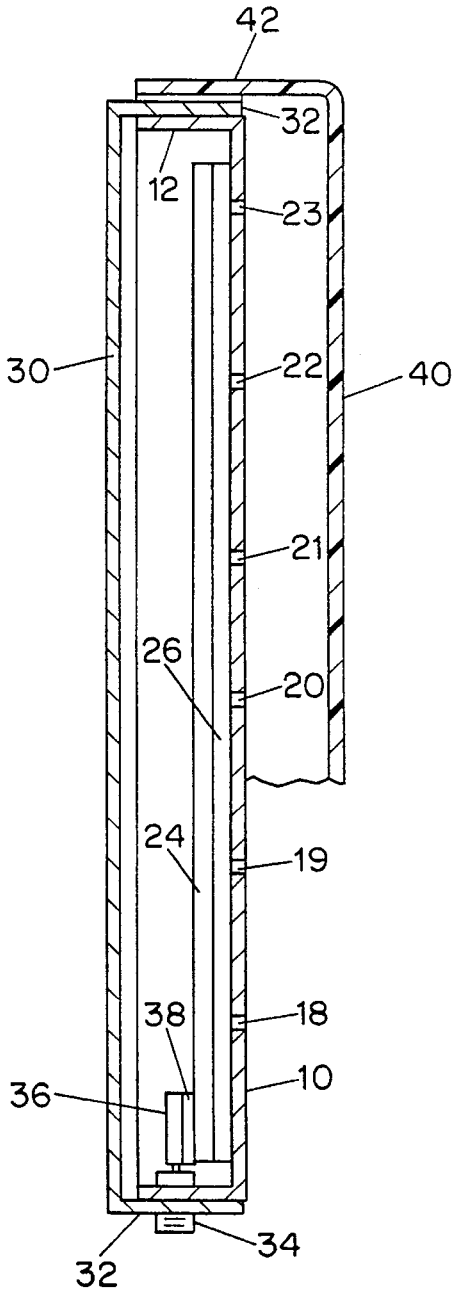
FIG. 2 is a side sectional view of the FIG. 1 antenna.
Figure 3:
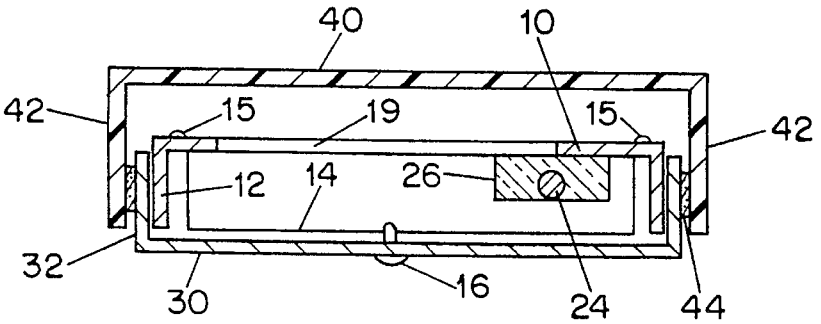
FIG. 3 is an end sectional view of the FIG. 1 antenna.
Figure 4:
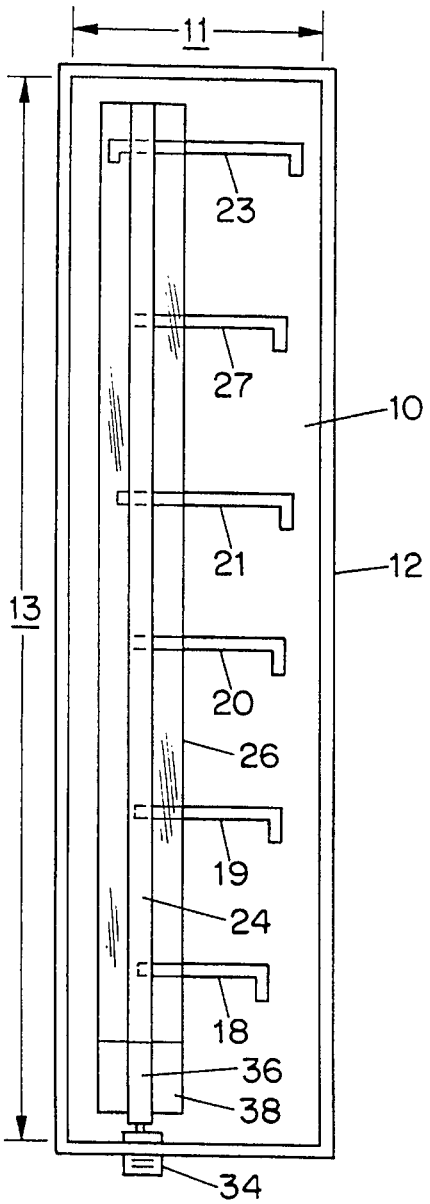
FIG. 4 is a back view of the slot and excitation arrangement used in the FIG. 1 antenna.

FIGS. 1–4 illustrate one form of slot array antenna in accordance with the invention. The upper portion of FIG. 1 provides a front view of the antenna covered by a radiation transmissive radome structure, which is cut away at the lower portion of FIG. 1. FIG. 2 is a side sectional view of the FIG. 1 antenna cut along vertical section 2—2 and FIG. 3 is a section 3—3 end view. FIG. 4 is a view of the slot array and excitation assembly removed from the FIG. 1 antenna and viewed from the rear. The drawings are not to scale and various dimensions have been distorted for easier comprehension.

As illustrated, the slot array antenna includes a first conductive sheet section 10, which in this configuration is the front planar portion of an aluminum alloy tray type structure which includes a perpendicularly extending wall or edge portion. As visible in FIGS. 2 and 3, the edge portion 12 extends back from each edge of sheet section 10 in the assembled antenna. While the antenna may be aligned in any desired orientation, for structural reference purposes the sheet section 10 has a horizontal dimension 11, a vertical dimension 13 and a thickness, as shown.

The antenna also includes a first array of slots comprising a plurality of radiating elements in the form of six vertically arrayed elongated openings 18–23 in the first conductive sheet section 10. As is visible in FIG. 4, at least one of the slots, e.g., slot 21, is offset horizontally relative to one other of the slots, e.g., slot 18. Actually, in the embodiment shown each of slots 19–23 is offset from slot 18 and each slot is also offset from its adjacent slots. As will be further discussed, such offsets affect the level of coupling of excitation signals for the respective slots. The use of slots as radiating elements is known in the antenna field and in an antenna constructed and tested the slots were each one-quarter of an inch wide, of differing lengths in the range of about 5 to 6 inches, and were provided with end sections in an L configuration for the purposes of achieving desired operating characteristics. As indicated, slot 23 also had a small perpendicular section at its other end for similar purposes. Slots 18–23 can be provided by simply punching openings of the desired size, configuration and positioning in a sheet of aluminum alloy sheet stock material adequately thick to retain structural integrity in its final form, or in other appropriate manner. Additional rigidity results from bending the edges 12 back to form the final tray type configuration.

The illustrated embodiment incorporates excitation means consisting of a single linear conductive member, shown as aluminum rod 24 visible in FIGS. 2, 3 and 4, and dielectric means 26 for supporting excitation rod 24 in spaced relation to the first conductive sheet section 10. As seen in the end-sectional view of FIG. 3, dielectric means 26 is a section of an extruded polyethylene member of rectangular cross section with an opening of circular cross-section dimensioned to accept and retain an aluminum rod of one-quarter inch diameter. Dielectric member 26 is fixed in place by small screws (not shown) extending through section 10 into portions of dielectric member 26 which are separated from rod 24 and the slots 18–23, or by other appropriate means. In FIG. 1, only small portions of dielectric member 26 are visible through the right-hand portions of slots 18 and 19. In FIGS. 2, 3 and 4 dielectric member 26 is represented as being transparent in order to more clearly show relationships between excitation rod 24, slots 18–23 and sheet section 10. Excitation rod 24 is positioned in spaced relation to the back side of sheet section 10 and, as shown in FIG. 4, extends across each of slots 18–23 for coupling slot excitation signals. Considering the relative positioning of rod 24 and slots 18–23, the FIG. 4 back view of sheet section 10 clearly shows the positioning of the linear (i.e., straight) conductive rod 24 with respect to the slots 18–23, whereby the respective horizontal offsets of the slots affects the level of coupling between each slot and rod 24. Thus, if excitation signals are coupled to the bottom of excitation rod 24 portions of such signals will be coupled in a series feed configuration to each of slots 18–23 in succession. The amplitude of the signal portion coupled to each slot will be determined by both the amplitude of signals on the rod at the slot and the level of coupling to each respective slot, as well as other factors typically taken into consideration in antenna design.

The antenna of FIGS. 1–4 further includes a second conductive sheet section 30, which in this configuration is the back planar portion of an aluminum alloy tray type structure which includes a perpendicularly extending wall or edge portion. As visible in FIGS. 2 and 3, the edge portion 32 extends forward from each edge of sheet section 30 in the assembled antenna. The horizontal and vertical dimensions of second sheet section 30 are somewhat larger than the corresponding dimensions 11 and 13 of first sheet section 10. With this construction, the tray structure formed of elements 10 and 12 can be nested within the oppositely-facing tray structure 30/32. Sheet section 30 may include suitable openings (not shown) usable in arrangements for mounting the antenna for use. Such openings may, for example, be combined with nuts fixed to the inside of section 30, so that screws holding a steel mounting bracket to the back of section 30 may be inserted through the holes and fastened in the captive nuts.

Figure 5:
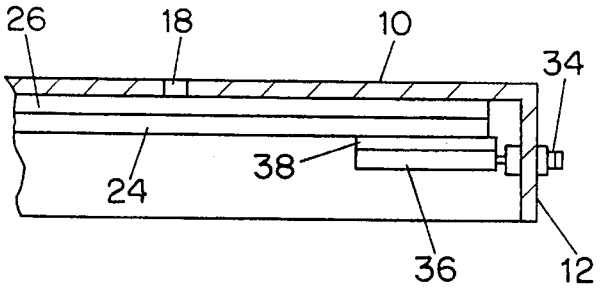
FIG. 5 is an enlarged partial view of the input/output coupling configuration of FIG. 2.

FIG. 5 is an enlarged view of the lower portion of tray structure 10/12 as shown in FIG. 2. In FIG. 5, dielectric member 26 is represented as being transparent in order to more clearly show the relationship of excitation bar 24 to the other elements. The FIG. 5 embodiment incorporates coupling means for enabling signals to be coupled to and from excitation bar 24 without requiring any metal to metal connection or contact in the signal path within the antenna. As illustrated, in this embodiment an appropriate form of standard electrical connector, 34 such as a weather resistant form of "N" connector, extends through and is fastened to the lower edge portion 12 associated with the first conductive sheet section 10. A conductive signal coupling rod section 36 is mounted to the center conductor of connector 34 and extends in spaced parallel relation to excitation rod 24. Coupling rod 36 may typically be a section of a conductive rod of one-quarter inch diameter and 1 to 3 inches in length, which is soldered, welded or otherwise permanently affixed to, or a part of, the center conductor structure of connector 34 so as to operatively form part of the connector structure. In the space between excitation rod 24 and coupling rod 36 there is positioned a section of suitable dielectric material 38, which may take the form of a short section of a dielectric extrusion similar or identical to dielectric means 26, as previously described. The resulting configuration, as shown, comprises a capacitive coupling means which both provides effective signal coupling and is free from metal to metal contacts in the signal path within the antenna. It will be appreciated that, depending upon the particular application, the antenna can be used for signal transmission, signal reception, or both, with signals coupled via connector 34. As will be discussed further, the capacitive characteristics of this coupling configuration are not conducive to coupling of low frequency components associated with lightning strikes from the antenna to associated electronic equipment. Structurally, the side wall portions 32 and 42 of the back and radome tray type structures are provided with cut outs sized to fit around the connector 34 protruding from edge portion 12, for ease of antenna assembly.

The FIG. 5 arrangement also includes shielding means 14, which in a preferred embodiment is positioned behind each of slots 18–23, but which is illustrated only in FIGS. 1 and 3. As illustrated, shielding means 14 is a conductive box structure having four sides and a back, with suitable cutouts to fit around the combination of rod 24 and dielectric 26 without contacting rod 24. As seen in dotted outline in FIG. 1, shielding box 14 encompasses slot 19 in spaced relation to the slot. The FIG. 1 illustration of shielding box 14 is typical and corresponding shielding boxes would be similarly positioned with respect to each of the slots 18–23 in this configuration. In the FIG. 5 view, welds are shown at 15 where tabs on the shielding box 14 pass through slots cut in section 10 and are welded in place. The use of welds in this form of construction fixes the shielding box in place, while avoiding the use of physical contacts which can give rise to spurious intermodulation effects related to the flow of shielding currents between box 14 and section 10 during use of the antenna. It has been found desirable to select the height of the side walls of shielding box 14, as positioned in FIG. 5, so that there is a relatively close fit between the inside of sheet section 30 and the bottom of box 14 as shown in FIG. 5. This provides increased structural rigidity which can be further increased by placement of one or more screws or other fasteners through section 30 into box 14 as shown at 16. The electrical quality of the connection provided by fastener 16 is not important since no significant current will flow through this connection.

In the configuration of FIGS. 1, 2 and 3, the antenna also includes a radiation transmissive radome structure. The radome structure includes a front planar section 40, which is the forward beam transmissive portion of a radiation transmissive tray type structure including a perpendicularly extending wall or edge section 42 extending back from each edge of front portion 40. The horizontal and vertical dimensions of portion 40 are somewhat larger than the corresponding dimensions of the 30/32 tray structure which includes the second conductive sheet section 30. This proportioning permits the radome structure 40/42 to be placed over the earlier described 10/12 and 30/32 tray structures. With this construction, a gasket 44 as represented in FIG. 4 or other sealing device inserted between the four sides of the overlapping side edges 32 and 42 of the tray structure 30/32 and the radome structure 40/42, and screws or other fasteners (not shown) placed through selected combinations of the edge portions 12, 32 and 42, enable the different portions of the antenna to be assembled into a weather resistant unit with structural integrity.

Operationally, the antenna of FIGS. 1–5 is designed to provide an azimuth beamwidth of approximately 90 degrees in the cellular telephone frequency band of 824 to 894 MHz, with an elevation beamwidth of approximately 15 degrees. The azimuth bandwidth can be reduced to about 50 degrees by use of side-by-side vertical arrays of slots (FIG. 8), or to about 25 degrees by use of four such arrays in side-by-side alignment(FIG. 9). The elevation beamwidth is dependent upon the number of vertically arrayed slots in each array. A five slot array can be used to provide an elevation beamwidth of about 24 degrees. As shown, the antenna is designed to provide a beam squinted downward so that the upper −3dB point of the beam will fall in the vicinity of the horizon when the antenna is mounted with vertical alignment. By changing vertical slot placement and spacing, a family of antennas with differing downward squints can readily be provided by punching the appropriate slots with appropriate spacing to result in antennas with beam peak, upper −6dB point or −9dB point, etc., at the horizon.

With the antenna implemented as represented in the drawings, the dielectric member 26, which may be extruded polyethylene, causes signals on the transmission line comprising excitation rod 24 and dielectric member 26 to have a transmission line wavelength which is less than the free space wavelength of signals of like frequency. As a result, the slots can be-more closely spaced vertically, while still producing a beam directed straight ahead on the antenna boresight. This puts the radiation patterns of the individual slots closer together vertically and is effective to reduce spurious grating lobes which would otherwise exist in the composite elevation beam pattern. The beam can also be squinted downward as discussed above, by adjusting the average slot to slot spacing.

Figure 6:
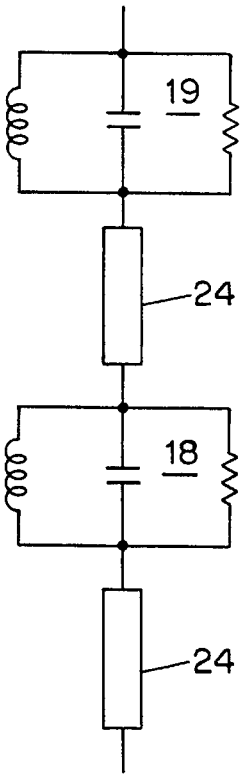
FIG. 6 is an equivalent circuit representation of a portion of a slot and excitation arrangement.
Figure 7:
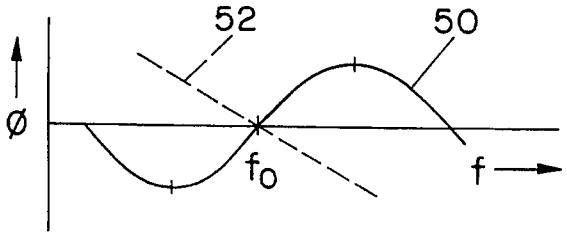
FIG. 7 illustrates phase versus frequency characteristics.

FIG. 6 is a representation of an electrical equivalent circuit of slots 18 and 19 and associated excitation transmission line segments between slots, shown as line segments 24. FIG. 7 includes curve 50 which represents the frequency-dependent characteristic of phase variation with frequency of a slot such as 18 or 19. As shown, relative to a design frequency $f_o$, the slot phase characteristic leads more (increases) with increasing frequency and lags more (decreases) with decreasing frequency. For a slot array antenna operated over a frequency band, the result will be an undesirable squinting of the antenna beam up or down, dependent upon frequency of operation. Conversely, the excitation transmission line comprising rod 24 and dielectric member 26 has a frequency-dependent characteristic of phase delay variation with frequency as represented by line 52 in FIG. 7. With reference to the opposite slopes of curves 50 and 52 in FIG. 7, it will be appreciated that with the antenna design as described the slots and the excitation transmission line have frequency-dependent characteristics which tend to counteract each other so as to provide improved antenna performance over the intended operating frequency band.

Additional design features of the antenna as shown include the following. Non-uniform vertical spacings of the slots of each array are employed in order to provide quadratic phase-front distortion of the composite beam, which results in reduction of nulls in the vertical radiation pattern of the antenna. The slot array design provides differing resonant frequencies, for the various slots of an array, which are staggered around a basic design frequency resulting in differing input impedances for different slots. However, overall slot excitation efficiency is thereby improved by providing an impedance averaging effect whereby the antenna feed input impedance has improved constancy over the operating frequency band. Antenna design principles and techniques, including computer analysis and simulation, are well established and implementation of the various design objectives and considerations which are discussed are within the capabilities of skilled individuals, once having an understanding of the invention and the embodiments shown and described.

Another feature of the invention is improved resistance to damage from lightning strikes. In embodiments of the invention as already described, the principal structural elements of the antenna are first and second conductive sheet sections which are fastened together to form a conductive metal enclosure encompassing the excitation arrangement. The radome is basically a passive dielectric cover. Depending upon the particular structural mounting arrangement, the conductive metal enclosure will be grounded through a metallic mounting bracket such as discussed above. Additional protection for receivers and other electrical components coupled to the antenna by interconnecting coaxial cable is provided by the design of the capacitive coupling means. As discussed with reference to FIG. 5, coupling rod 36 is not in direct electrical contact with the excitation rod 24. The capacitive coupling arrangement provided with the inclusion of dielectric member 38 provides a level of isolation, particularly in view of the low frequency energy components associated with lightning strikes. Thus, two levels of protection are provided for associated electronic equipment. The excitation rod 24 is enclosed within, and isolated from, the conductive metal enclosure formed by tray type sections 10/12 and 30/32. In addition, excitation rod 24 is dielectrically isolated from the coaxial transmission line feeding the antenna.

Figure 8:
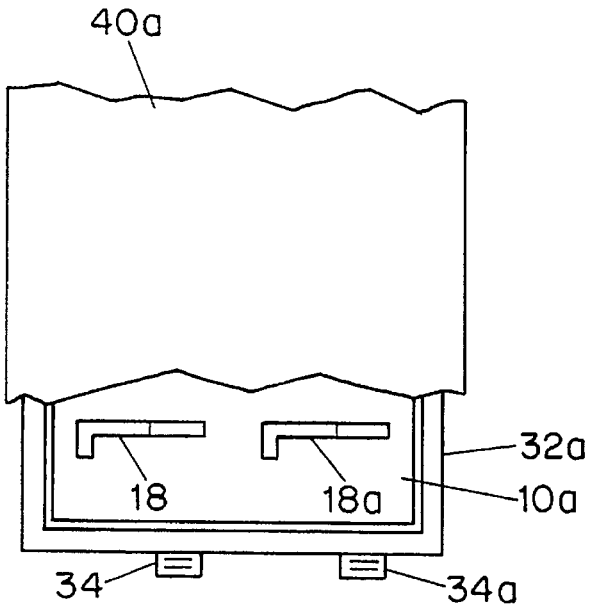
FIG. 8 shows a FIG. 1 type antenna including a second slot array.
Figure 9:
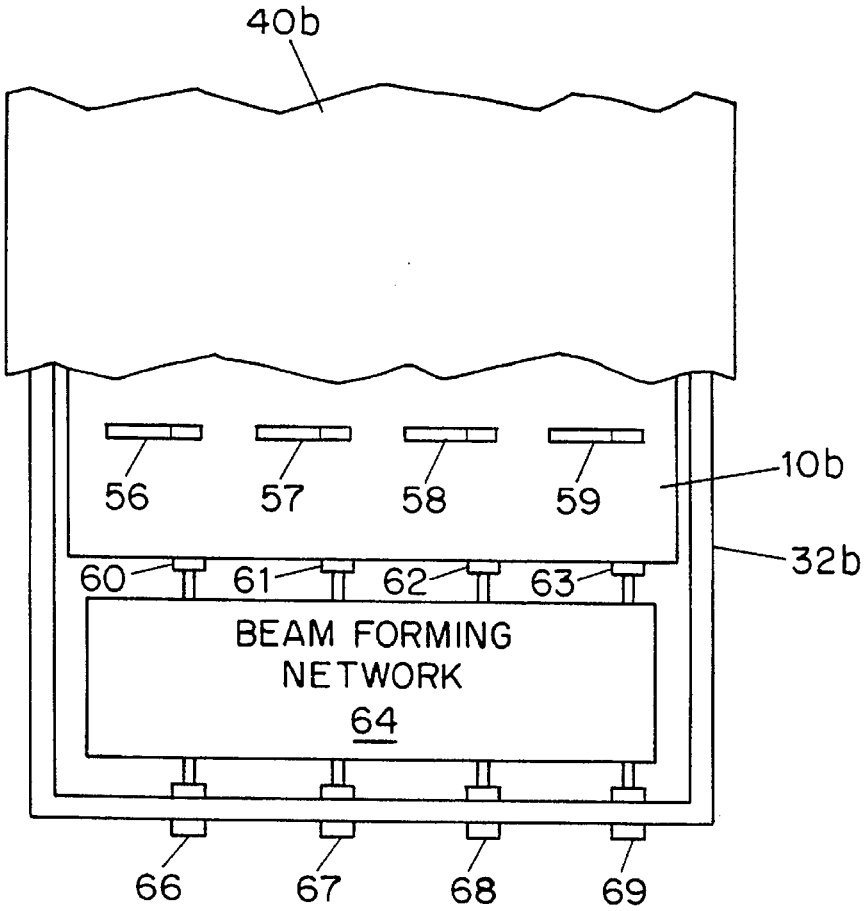
FIG. 9 shows a FIG. 1 type antenna including four slot arrays with a beam forming network.

Referring now to FIGS. 8 and 9, there are shown slot array antennas in accordance with the invention which respectively include two and four arrays of slots. FIG. 8 illustrates a two array antenna comprising a first array (including lower slot 18) as shown in FIGS. 1–5 and a second similar array (including lower slot 18*a*) with associated excitation means and dielectric means as described (not shown). Overall, the construction is similar to the construction of the antenna of FIGS. 1–5, including radome 40*a* and first conductive section 10*a* and coupling means for providing individual array outputs at two connectors 34 and 34*a* as shown in FIG. 8. Alternatively, the excitation means of each of the arrays of the FIG. 8 antenna may be internally combined and externally coupled via a single connector, to provide an antenna with a narrower horizontal beamwidth. The FIG. 9 antenna is generally similar to the FIG. 8 antenna, but includes four vertical arrays of slots shown in a simplified format. Each array (represented by one of the lower slots 56–59) is coupled to a respective one of output connectors 60–63. Connectors 60–33 thus comprise coupling means providing a separate port for each array, which in turn are connected to a beam forming network 64. With this arrangement beam forming network 64, which may be a known type of Butler network, provides a beam forming or modification function with the result that signals representative of four beams with modified characteristics are coupled to the individual output connectors 66–68 in well-known manner.

Figure 10:
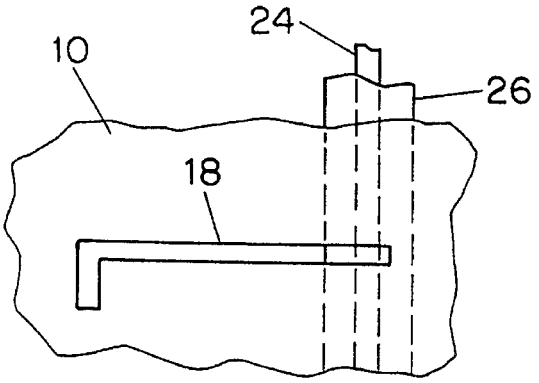
FIG. 10 is an expanded view of a portion of FIG. 1.
Figure 11:
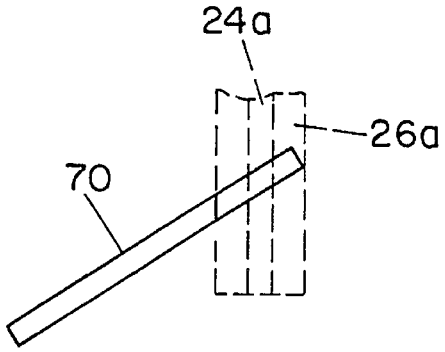
FIGS. 11 and 12 illustrate alternate slot configurations usable in antennas in accordance with the invention.
Figure 12:
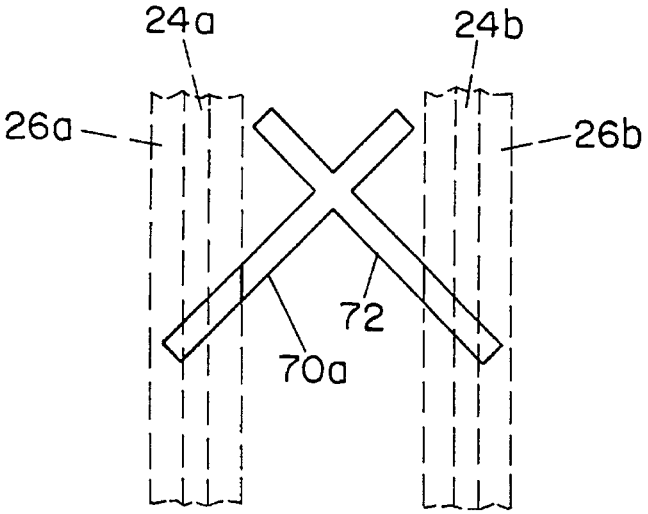

FIGS. 10–12 illustrate forms of slots which may be utilized in antennas in accordance with the invention. FIG. 10 shows an enlarged view of slot 18 of the antenna of FIGS. 1–5, with a portion of first section 10 and excitation rod 24 supported by dielectric member 26. FIG. 11 shows a simplified view of a diagonal slot 70 overlying rod 24*a* and dielectric member 26a of similar construction as elements 24 and 26 of FIG. 10. Slot 70 is effective to provide a diagonal linear polarization. In FIG. 12 a slot 70*a*, which is one of an array of slots as represented by slot 70 in FIG. 11, has superimposed upon it slot 72 of a second array of slots diagonally aligned at 90 degrees to slot 70*a*. As shown, slot 72 is positioned so that it intersects slot 70*a* at an angle which will typically be at least 45 degrees. In FIG. 12, a second conductive member shown as excitation rod 24*b* and associated dielectric member 26*b* are shown crossing the end of slot 72. With this configuration an antenna may be arranged to operate with dual linear diagonal polarizations, or right or left hand circular polarization or both. In other antenna configurations in accordance with the invention a vertical array of slots linearly aligned without offsets may be combined with a series excitation conductor or rod which is not linear, but which has bends or offset sections arranged to provide different levels of coupling and excitation as it crosses successive slots. While an excitation rod with bends or offsets may be more difficult to implement, many of the other advantages and features of the invention will be obtained in antennas using such rods.

Figure 13:
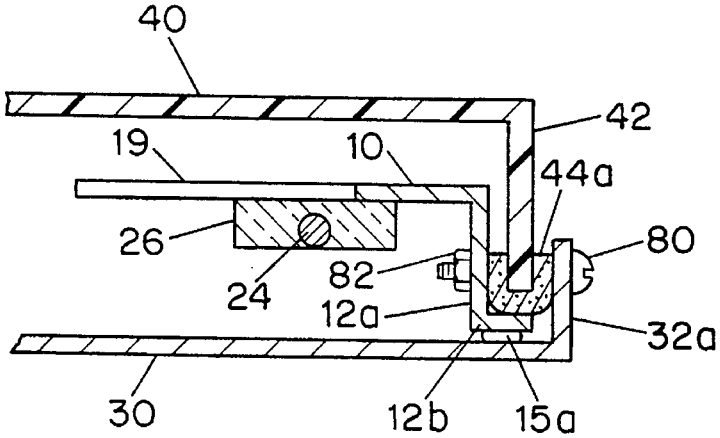
FIG. 13 shows an alternative form of construction relevant to the right end of the structure shown in FIG. 3.

With reference to FIG. 13, there is shown an example of an alternative form of construction which can best be considered with reference to the right hand portion of FIG. 3. FIG. 3 shows the interrelationship of edge portions 12, 32 and 42 and gasket 44, which is typical of the structural configuration on each of the four sides of the FIG. 1 antenna. In FIG. 13 edge portion 12*a* of sheet section 10 includes an additional outward-extending lip 12*b*. Sheet section 30 is large enough so that its edge portion 32*a* can encompass lip 12*b* on all four sides of the antenna. In assembly, lip 12*b* is spot welded (15*a*) to sheet section 30 to form a structural enclosure with electrical interconnection not subject to development of spurious intermodulation effects as previously referred to. The edge portion 42 of radome 40/42 fits into the space between edge portions 12*a* and 32*a* in cooperation with sealing gasket 44*a*. Fasteners, such as screw 80 cooperating with captive nut 82 fixed to the inside of edge section 12*a*, pass through edge sections 32*a* and 12*a* at locations on the sides of the antenna to hold the radome 40/42 in place. With reference to FIG. 1, in the FIG. 13 type of construction box structure 14 can be replaced by partial transverse partitions of aluminum which resemble the upper and lower dotted portions of box 14 without the left and right side portions of box 14 as included in FIG. 1. One such partial transverse partition is spot welded in place intermediate between each adjacent pair of slots. With the FIG. 13 construction the basic antenna components are welded together to form an enclosure encompassing the feed rod 24 and coupling rod 36. While there will be very limited need to service such internal components, an access opening can be provided on the bottom of the antenna (e.g., adjacent to connector 34 in FIG. 1) and made accessible by removal of radome 40/42. While specific structural details have been described, many variations can be provided by skilled persons in application of the invention. With respect to lightning strikes, it will be appreciated that welded aluminum construction such as used in FIG. 13 provides increased protection and can incorporate the protective aspects of the capacitive feed configuration as already described.

In a particular design of the type of antenna shown in FIGS. 1–5 for use in cellular telephone applications, the first conductive sheet section 10 had a width 11 of approximately 8 inches and a height 13 of approximately 54 inches. The slots 18–23 had differing lengths in the range of 5 to 6½ inches, with vertical slot to slot spacings in the range of 7½ to 9 inches. The end of each slot adjacent to the excitation bar had a different horizontal offset relative to the bar centerline. Each slot was one-quarter inch wide and basically L shaped, with the shorter perpendicular portion of the L having a length in the range of about 1 to 2 inches. The antenna was designed to accommodate transmission signals of 500 watts average power.

While there have been described the currently preferred embodiments of the invention, those skilled in the art will recognize that other and further modifications may be made without departing from the invention and it is intended to claim all modifications and variations as fall within the scope of the invention.

What is claimed is:

1. A slot array antenna, with lightning resistant qualities, comprising:

a first conductive sheet section including a vertically-extending linear array of open slot radiating elements each having a principal dimension transverse to vertical;

a conductive excitation rod, positioned behind said first conductive sheet section and extending vertically, for coupling slot excitation signals successively to said slot radiating elements in a series feed configuration;

dielectric support means, extending along said excitation rod between said rod and said slot radiating elements, for supporting said excitation rod behind said slot radiating elements;

a second conductive sheet section positioned behind said first conductive sheet section and said excitation rod and conductively fastened to said first conductive sheet section; and coupling means for enabling signals to be capacitively coupled to and from said excitation rod, said coupling means including:

an end portion of said excitation rod;

a conductive signal coupling rod coextensive with and aligned in spaced parallel non-contact relation to said end portion of said excitation rod;

second dielectric means positioned between said end portion of said excitation rod and said signal coupling rod; and an input/output connector connected to said signal coupling rod;

said first and second sheet sections forming a groundable conductive shell with said excitation rod and signal coupling rod positioned in non-contact relationship within said shell.

2. In a slot array antenna as in claim 1, means wherein said excitation rod and said coupling rod are sections of aluminum rod of circular cross section and said second dielectric means includes a cavity of at least partially circular cross section for receiving said coupling rod.

3. A slot array antenna as in claim 1, wherein said of slot radiating elements comprise a vertical array of horizontally extending openings in said first conductive sheet section, and at least two of said slots have different horizontal offsets relative to said excitation rod, which extends vertically behind said slots.

4. A slot array antenna as in claim 1, additionally including a radiation transmissive radome structure enclosing said of slot radiating elements.

5. A slot array antenna as in claim 1, wherein each of said slot radiating elements has a different principal horizontal dimension.

6. A slot array antenna as in claim 1, wherein said excitation rod is vertically aligned and each of said slot radiating elements has a principal dimension which is diagonally aligned at an angle to vertical.

* * * * *